US005702082A

United States Patent [19]

Evans et al.

[11] Patent Number: 5,702,082

[45] Date of Patent: Dec. 30, 1997

[54] LAMP-HOLDING HOOK CLAMP

[75] Inventors: Nigel Evans; William E. Hewlett, both of Pasadena, Calif.; Richard Parker, Birmingham, United Kingdom

[73] Assignee: Light & Sound Design Ltd., Birminingham, England

[21] Appl. No.: 453,505

[22] Filed: May 30, 1995

[51] Int. Cl.[6] ..... A47B 96/06

[52] U.S. Cl. ..... 248/230.1; 248/214; 248/230.4; 362/396; 362/430

[58] Field of Search ..... 248/316.5, 230.4, 248/231.51, 229.13, 229.23, 214, 340, 230.1; 362/382, 396, 404, 416, 430, 431, 432

[56] References Cited

U.S. PATENT DOCUMENTS

| | | | |
|---|---|---|---|
| 567,157 | 9/1896 | Noyes | 248/231.51 X |
| 577,429 | 2/1897 | Homan | 248/230.4 |
| 1,509,022 | 9/1924 | Noble | 248/230.4 X |
| 1,760,458 | 5/1930 | Weber | 248/229.13 X |
| 3,706,437 | 12/1972 | Eberhardt | 248/230.4 |
| 3,936,023 | 2/1976 | Clifton | 362/396 |
| 4,225,104 | 9/1980 | Larson | 248/316.5 X |

FOREIGN PATENT DOCUMENTS

| | | | |
|---|---|---|---|
| 889181 | 12/1971 | Canada | 248/316.5 |

*Primary Examiner*—Ramon O. Ramirez
*Assistant Examiner*—Anita M. King
*Attorney, Agent, or Firm*—Fish & Richardson, P.C.

[57] ABSTRACT

A hook clamp has surfaces allowing the clamp to be placed on a support and clamped thereto. The surfaces are such that the clamp can be placed on the support and its weight held by the support prior to tightening.

11 Claims, 5 Drawing Sheets

LAMP-HOLDING HOOK CLAMP

FIELD OF THE INVENTION

The present invention relates to a clamp for holding a stage-mounted device relative to a stage support truss. More specifically, the present invention defines a hook clamp which has a portion that hooks over the support truss and surfaces which press against the truss to hold the weight and position of the stage-mounted device while it is being mounted to the support truss.

BACKGROUND AND SUMMARY OF THE INVENTION

Many stage-mounted devices, more generally, loads, require a stable base of support. Moving lights are one such stage-lighting device which require a stable base. Typically, moving lights are electronically controllable to move between various positions and to provide special effects. In order for a moving light to provide its desired characteristics, the system must have a very stable base of support. Moreover, because of the lamp size, cooling requirements, and complicated electronics, these lamp devices can be very heavy. Many times such lights are mounted at the upper area of the stage, very high off the ground.

Many hook clamps are known in the art. Some of the commonly used ones are described herein. A Cheeseborough clamp (U.S. terminology) or Scaff clamp (U.K. terminology) is shown in FIG. 1. The clamp 100 is shown in its open position in FIG. 1. The moving part 122 of the clamp pivots around pivot point 104 to form a closed clamp as shown in FIG. 2 which closes around the supporting pipe. The clamp can be tightened by tightening bolt 106 relative to bolt accepting mechanism 108, which can be a slot or the like in a plate. The appropriate tightening reduces the size of the inner surfaces, to tighten the clamp and to maintain the lamp in position relative to pole 200.

The inventor of the present invention recognized that this system is very difficult for the installers to use. One main reason is because the entire weight of the lamp must be supported by the installer while attaching the lamp to the pole 200. FIGS. 1 and 2 show these clamps in the open and closed position, respectively to demonstrate the installation. In order to install the lamp, the installer must hold lamp 110 while placing the open clamp 100 against pole 200 and while holding surface 120 of the open clamp against the supporting pole 200. The clamp is hinged around pivot 104 to form a cylindrical inner area 205, as shown in FIG. 2. Bolt 106 holds relative to bolt accepting element 108.

In order for the lamp to be properly attached to the supporting pole 200, therefore, this means that the bolt 106 must be screwed into the acceptor 108 (e.g., a nut or a split holder). Alternately, a wing nut or like mechanism on element 108 can be screwed into bolt 106. In any of those cases, the installer must hold the weight of the lamp, which can be as heavy as 60 pounds, while holding the clamp closed and simultaneously screwing the nut into place. Moreover, even once the nut is screwed into place, the lamp is still not maintained in its proper position relative to the pole until the nut and screw 106, 108 are properly tightened.

These most-common kind of lamp clamps have been recognized by the inventors of the present invention to cause problems, making the lamps very difficult to install.

A second kind of mounting mechanism is shown in FIG. 3. The lamp 110 is connected to a folded piece of metal 300 which includes downwardly extending portions 302 and 304, and a connecting portion 306. The inside surface 308 of clamp 300 is placed against the supporting pipe 200. Since the metal is formed of folded flattened metal sheets, the inside surface 308 touches the pipe only at tangent points between the flat surfaces and the round pipe, such as 310. Rotation of lamp 110 relative to pole 200 is prevented by tightening set screw 312 against point of contact 314 on the pipe 200.

There are a few problems with this system. Significantly, this system allows the weight of the lamp to be placed on the pole prior to tightening the set screw 312. However, the lamp will still rotate relative to the pole, at least until the set screw is tightened against the pole. Moreover, this design tends to distort the roundness of the pole because of the large amount of force at the location where the set screw end 316 touches the pole. As can easily be seen, moreover, the system is inherently unbalanced, because the lamp must be spaced from the center of the pole.

It is an object of the present invention to overcome these disadvantages, and to provide a system which allows an installer to more easily mount a light on a supporting truss. This is done according to the present invention by providing an element which has interior surfaces defining an area which approximates in shape the outer surface of the supporting truss, over at least over half of the outer surface of the truss support, preferably in a way that maintains the lamp in its proper position relative to the truss even prior to frictional tightening. A movable element tightens a tightening device into contact with the support element to maintain the lamp in position. The inventor recognized that the combination of an inner surface approximating the outer surface of the support pole, and a design that allows hooking over the support pole, produces a much easier-to-use system.

BRIEF DESCRIPTION OF THE DRAWING

These and other aspects of the invention will now be described in detail with reference to the accompanying drawings, wherein.

DESCRIPTION OF THE EMBODIMENTS

Figure 1:
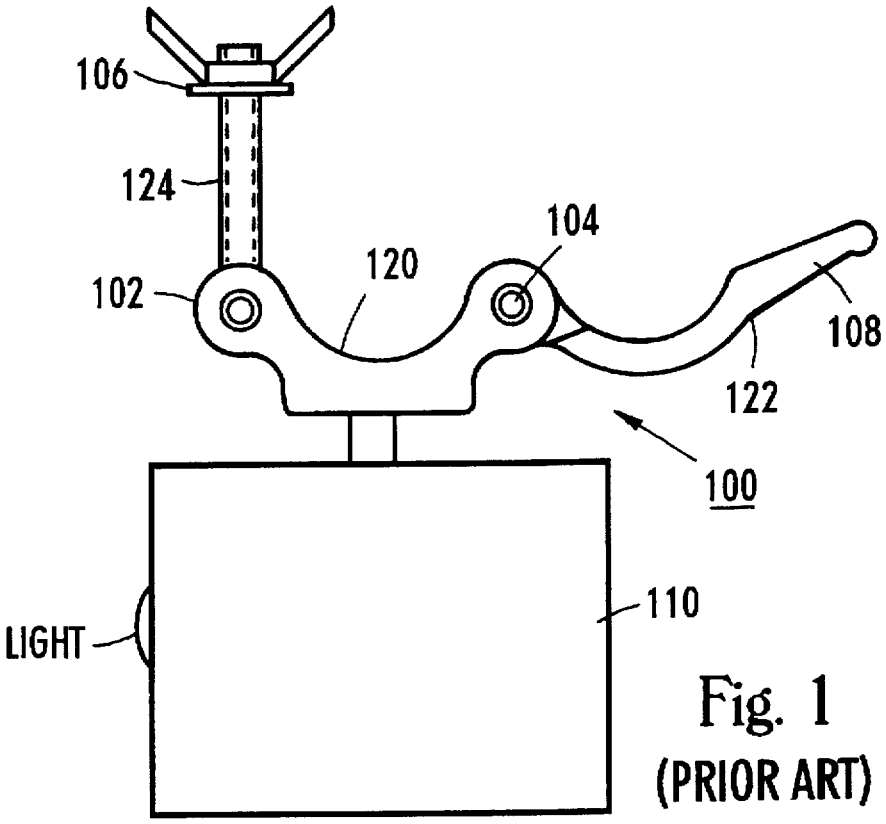
Fig. 1 (PRIOR ART)
FIG. 1 shows a Cheeseborough clamp of the prior art in the open position.
Figure 2:
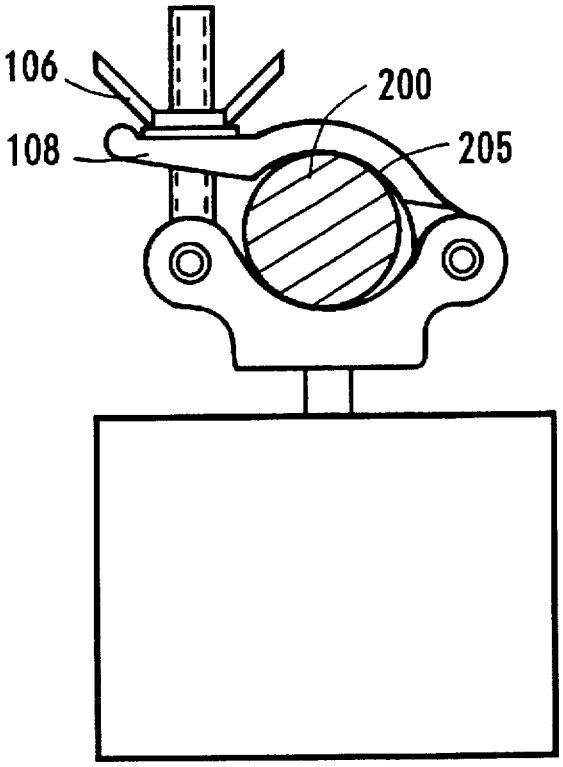
Fig. 2 (PRIOR ART)
FIG. 2 shows the Cheeseborough clamp in the closed position.
Figure 3:
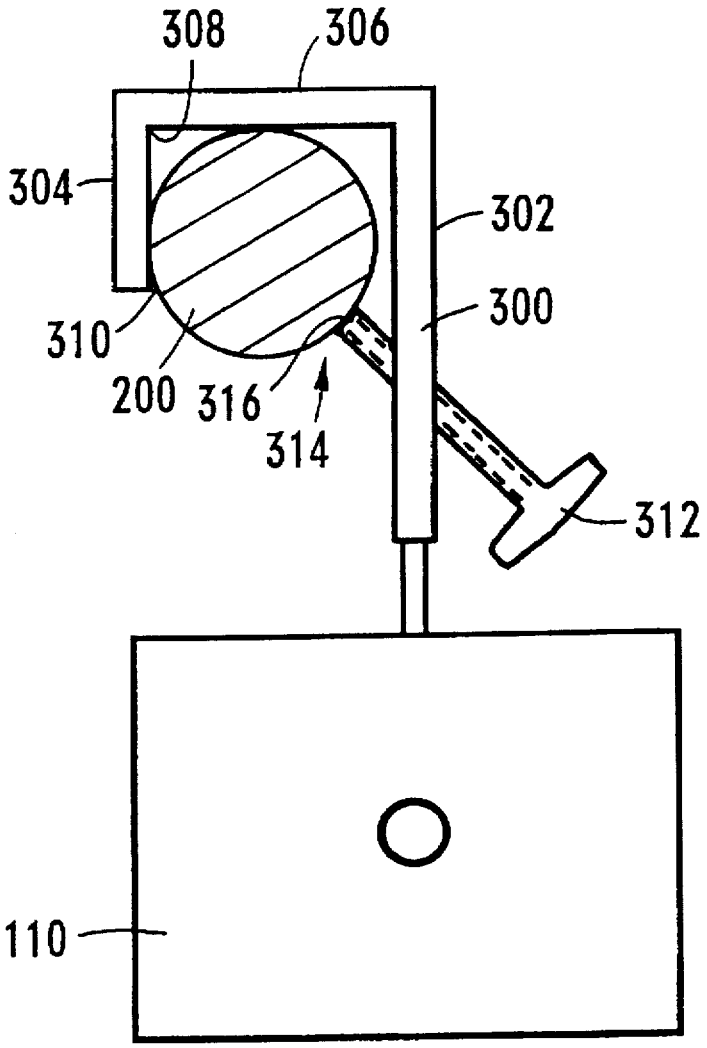
Fig. 3 (PRIOR ART)
FIG. 3 shows another clamp of the prior art.
Figure 3A:
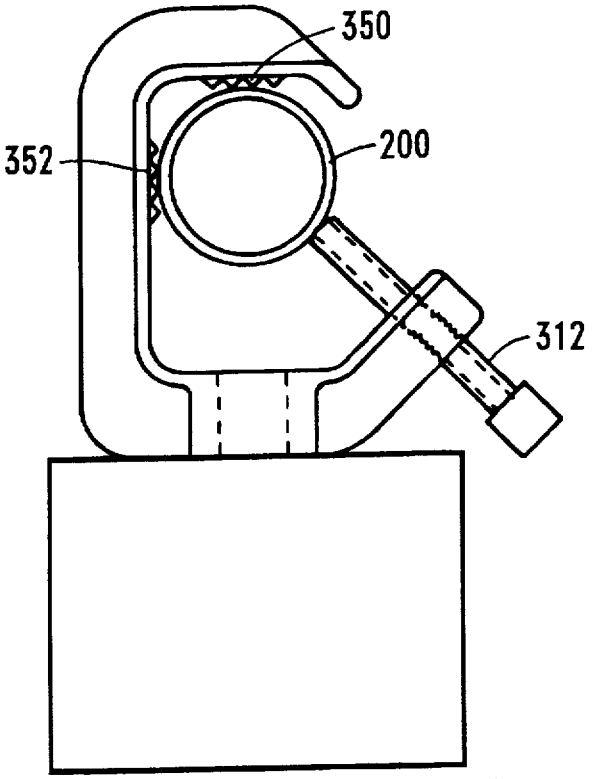
Figure 4:
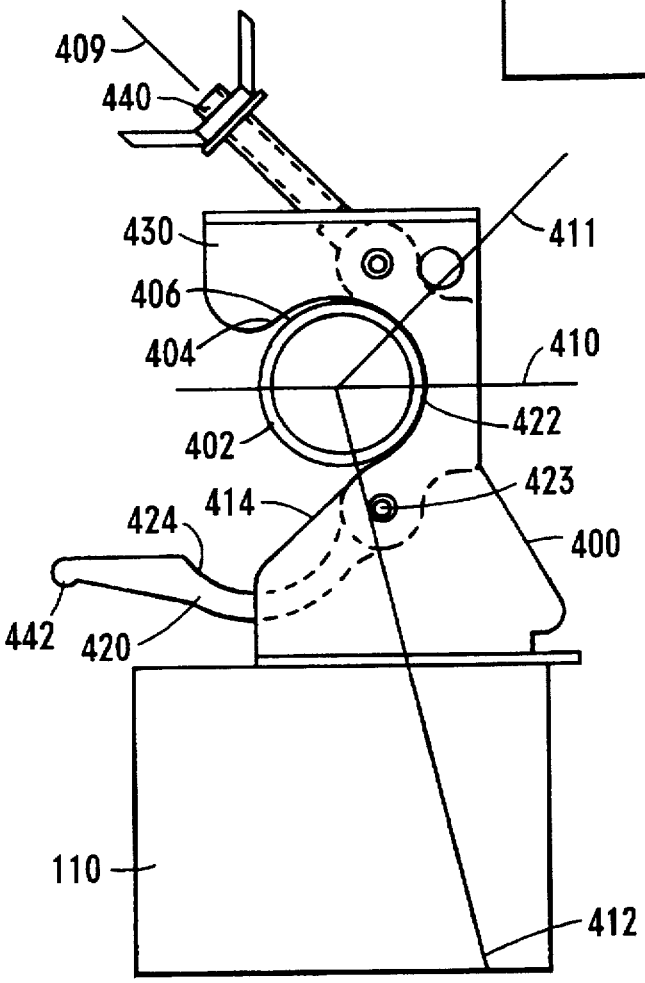
FIG. 4 shows a side view of the clamp of the present invention in the open position.

FIG. 4 shows an embodiment of the invention which includes lamp 110 connected to the hook clamp 400 of the present embodiment. More generally, any load could be attached to hook clamp 400. Hook clamp 400 is adapted to surround a substantially cylindrical support 402 to hold the weight of light 110.

The hook clamp includes inner surfaces 404 which are substantially the same size and shape as the outer surface 406 of the support 402. By this is meant that the inner surfaces are sized and shaped similarly to the support, sufficiently that there is a maximal friction between the two to keep the clamp in position even prior to tightening. This embodiment uses a base portion element having inner surfaces 404 at least along a portion thereof which are similarly cylindrical. The line 410 indicates a dividing line. Inner surfaces 404 above the dividing line 410 are cylindrical in shape and of substantially similar shape to the outer surface 406 of the support. A second portion including portions between lines 411 and 412 are also cylindrical. The pressure of outer surface 406 against inner surface 428 of hook portion 430 presses cylinder 402 backwards into cylindrical surface area 422—between lines 411 and 412.

A third portion including surface 414 preferably includes relatively flat surfaces against which the pole is pressed during the initial time while a hook portion 430 having a first portion extending below the top of the support is being hooked into position over the pole.

Figure 5:
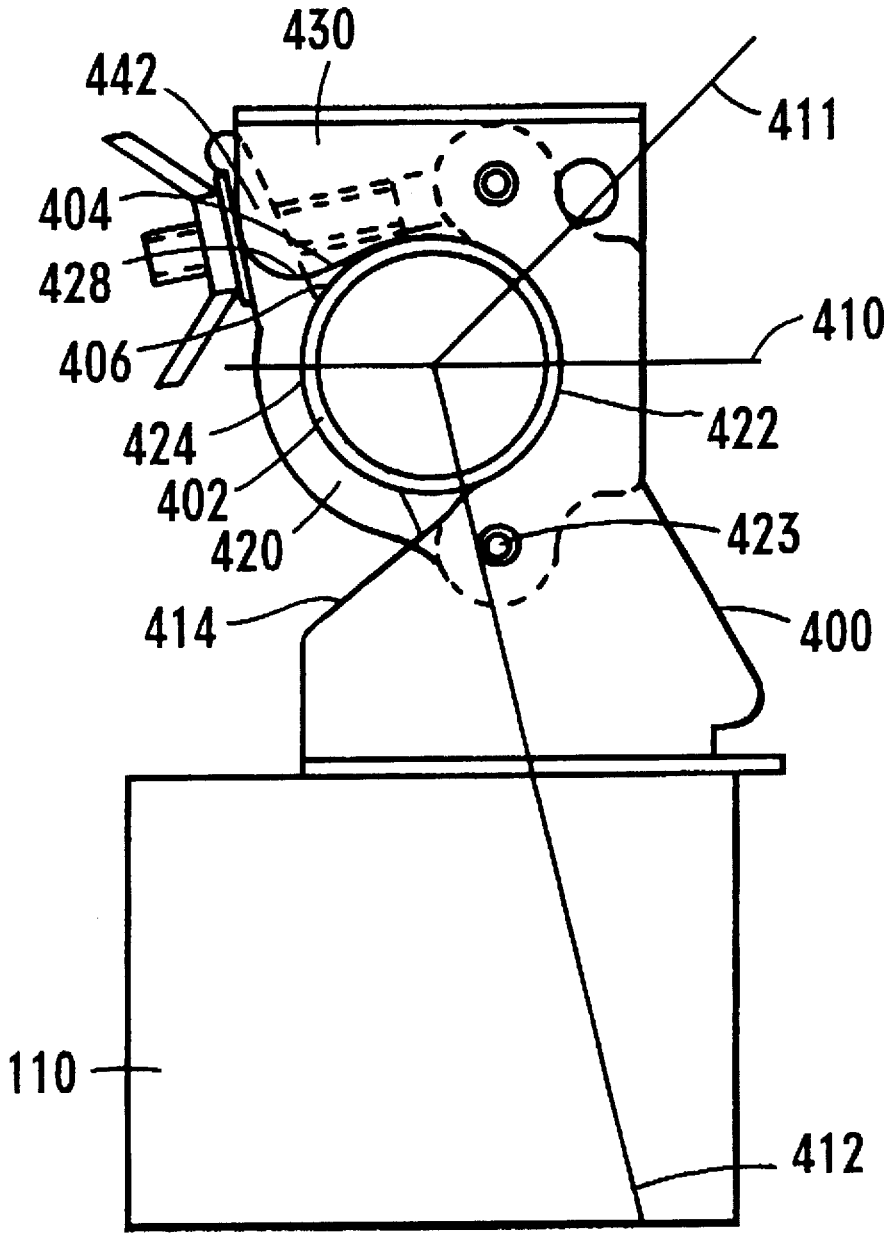
FIG. 5 shows the clamp of the present invention in the closed position.

A closable element such as tongue 420, which pivots around its pivot point 422, and can be moved into a position where the inside surface 424 frictionally engages against the support member 402. This final position is shown in FIG. 5, with the surface 424 abutting against the outer surface of the support 402. The other surfaces 406 of the support which are above the line 410 also abut against the inner surfaces 404 of the internal cylindrical element. Inner surface 424 of the tongue is preferably concave and similar in shape to the outer surface of support 402.

In operation, the user "opens" the tongue 420 by lowering it to its lowermost position, and first hooks the device over the support member 402. The support member 402 comes in contact with surface 414, and later the hooked end 430 is located above and hooked over the top support surface 406. At that time, the outer surfaces 406 of support 402 contact with inner surfaces 404 of the clamp 400. The lamp 110 is preferably located at the center of gravity of the clamp, to minimize side-to-side torque on the clamp. The friction of the close fit between the inner surfaces of the clamp and the outer surfaces of the support pole therefore are enough to keep the lamp steady and in position.

The tongue 420 is then lifted into position engaging a closure mechanism including bolt 440 and notch 442. This is done by placing the bolt 440 into corresponding notch 442. Notch 442 can be in hook portion 430 or in tongue 420. When the bolt is tightened, it holds the inside surface 424 into close frictional contact with the support 406. This tightens the clamp around the pole, so that the support is frictionally held by many similar-shaped surfaces. Since many surfaces of the pole are held, less tightening is necessary and hence there is less chance of distorting the pole shape. Preferably, many of the parts of the clamp are of similar shape to the outer surface of the pole. All portions above the line 410 are of similar shape, and preferably this is approximately 140° of the circle defined by the cylinder. Preferably all portions between the lines 411 and 412 also define arcs which are circular and which hence closely approximate the shape of the pole. The position from the left part of line 410 to the right part of line 412 preferably defines about 250° of the circle. An additional 30° or so also has similar shaped elements in the surface 424. Accordingly, preferably 280° of the circle defined by the cylinder are substantially the same shape as the surface of the pole. This means that only 80° is not, meaning that 75 percent of the outer surface of the pole is preferably gripped by similar-shaped surfaces of the clamp.

Figure 6:
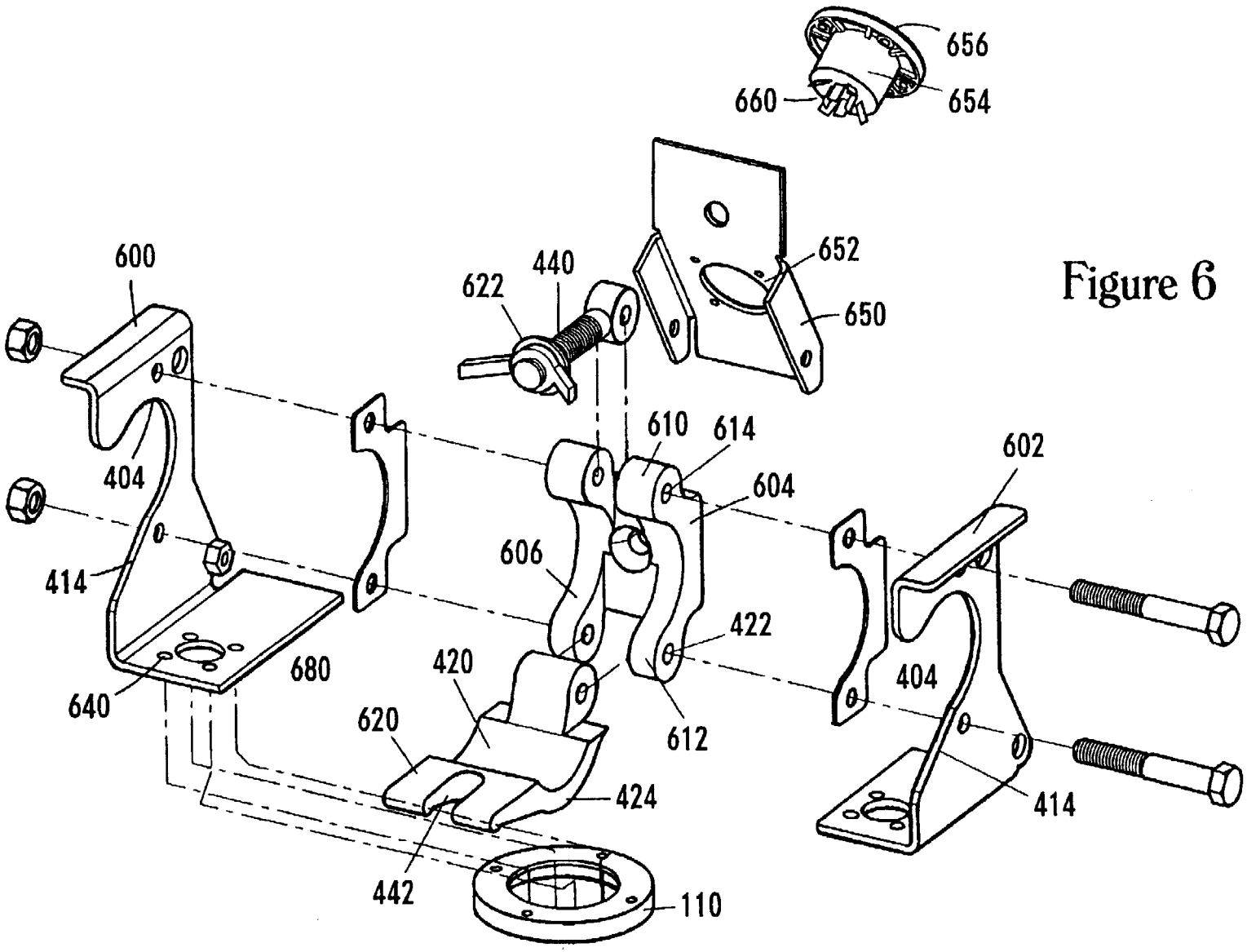
FIG. 6 shows an exploded view of the clamp of the present invention.

FIG. 6 shows an exploded view of the multiple parts making up the hook clamp of the preferred embodiment. The hook clamp body is formed of two bent elements of sheet metal, including left member 600 and right member 602. Each has a cylindrical surface 404 and flat surface 414. The two flattened elements are bolted together through a rear surface element 604 which has inner surfaces 606 defining substantially a portion of a cylinder. The hook clamp is bolted together to form an element having left and right pieces 602, separated by the width of piece 604. In order to allow the pieces 440 and 420 to pivot, spacer elements 642 and 644 are provided between the central element 606 and the respective end elements 602. This prevents the pinching which would otherwise prevent the tongue 420 from swinging without hitting the sheet metal elements 600, 602.

The piece 604 also includes top and bottom split portions 610 and 612. Each of the split portions includes a movable element therein which is pivoted about a pivot point. The "top" split element 610 pivots bolts 440 therein. Bolt 440 can be pivoted about pivot point 614 to be swung up and out of the way for attachment of the lamp, and later swung into place for securing the hook clamp. Lower split portion 612 accepts the tongue therein and pivots the tongue axis 422. Tongue 420 also includes the split portion 442 therein which has surfaces 620 which press against corresponding surfaces 622 of the bolt. When the bolt is tightened, the surfaces 622 press against the surfaces 620 to press tongue surfaces 424 closer to the surfaces 606. This has the effect of making the internal surfaces defining the cylinder smaller, to thereby press the hook clamp more tightly against the cylindrical support.

The left and right pieces 600 and 602 include mounting hole 640 therein, preferably at a center of gravity of the clamped device. Mounting holes 640 receive screws thereinto and screw into the lamp 110.

Although only a few embodiments have been described in detail above, those having ordinary skill in the art will certainly understand that many modifications are possible in the preferred embodiment without departing from the teachings thereof.

All such modifications are intended to be encompassed within the following claims.

What is claimed is:

1. A support apparatus for holding a lamp comprising:

a cylindrical support having a predetermined outer size and shape; and a clamp comprising:

a first base portion, comprising inner surfaces including a first inner surface having a shape which is substantially the same size and shape as an outer surface of said support, said base portion including at least a first hook portion which forms a cylindrically-inner shaped notch portion having inner surfaces which are substantially the same size and shape as the outer surface of said support, said hook portion hooking over the cylindrical support to form a first portion which extends below and contacts a top of the support on a first side of the support to form a hooked area, a second portion which is substantially the same size and shape as the outer surface of said support, and which extends below said top of the support on a second side of the support, and an opening, a closable element, movable relative to said first portion between a first position where said opening is open, and a second position where said opening is closed, a closure mechanism, connected to said first portion and to said closable element, and connectable between said first portion and said closable element when said closable element is located in said second position to close said opening, and selectively tight-enable to tighten inner surfaces of said hook clamp against said opening, and a lamp attachment portion coupled to the first base portion aligned directly below said top of the support, disposed such that substantially all the weight of said clamp is borne by said first and second portions, when said closeable element is in said first open position.

2. A hook clamp as in claim 1 wherein at least 75 percent of the inner surfaces of said first base portion and said closeable element are substantially the same size and shape as said cylindrical support.

3. The support apparatus as in claim 1 wherein said lamp attachment portion is located in an area at substantially a center of gravity thereof.

4. A hook clamp as in claim 1 wherein said first base portion further includes a third portion which extends below said second portion to form a first part of the opening, a second part of the opening formed by an end of said hook portion, formed by said first portion, facing said third portion.

5. The support apparatus as in claim 1 wherein said closeable element includes a portion having inner surfaces which are substantially the same size and shape as said outer surface of said support.

6. The support apparatus as in claim 5 wherein said closure mechanism comprises a first hinged element, and a second element which is selectively reducible in size, said second element including a surface pressing against a corresponding surface of said closeable element when mated thereto and such that when said closeable element is reduced in size, said closeable element is drawn closer to said first portion.

7. The support apparatus as in claim 1 wherein said first base portion extends below a highest portion of the hook clamp by a first specified amount, and a portion of inner surfaces of said first base portion within said first specified amount on both sides of the cylindrical support are substantially the same shape as said outer surface of said cylindrical support.

8. A surface holding apparatus, comprising:

a clamp comprising:

a support member; and a first base portion, having an inner surface at least a portion of which is approximately the same size as an outer surface of said support member having a predetermined outer size and shape, said inner surface including a top area, a first hook area which extends below said top area in a first direction, and which defines a first part of an opening to said clamp at an end of said hook area, a second area which extends on the other side of said top area from said hook area, and which includes at least a portion which has an inner surface which is substantially the same size and shape as the outer surface of said support member, and an entry portion, having surfaces which define another side of said opening against which said support member can be located;

a closable element, which closes said opening to hold said support member therein;

a closure mechanism, which holds said closable element to cover said opening, and adjusts a position of said closure mechanism relative to said opening to tighten and loosen relative to said support member; and a load attachment portion coupled to said first base portion, said load attachment portion being aligned directly below said top of the support member, wherein a load is attachable to a load holding area directly below said load holding area, said load being aligned directly below said top of the support member, wherein substantially all of the weight of the load is borne by said first base portion when said closeable element is in said open position.

9. The surface holding apparatus in claim 8 wherein at least part of said closable element has an inner surface which is the same size and shape as said outer surface of said support element.

10. The support holding apparatus in claim 9, wherein when said support member is closed, 75 percent of surfaces of said clamp contact said support member.

11. A support apparatus for holding a load relative to a support member, comprising:

a support member having a predetermined outer size and shape;

a clamp comprising:

a base portion, having an inner surface shape which is substantially the same as said predetermined outer size and shape of said support member;

a hook element, coupled to a side of said base portion, and forming a hook area;

said hook element also including a bottom piece, which includes a load holding area;

a closable element, which closes around said support member when in a closed position, and when in an open position, forming an opening permitting the support member to enter the hook area, the closeable element having inner surfaces which are substantially the same size and shape as said support member; and said load holding area, located below said top of the support, wherein said load is attachable to said load holding area aligned directly below said load holding area said load being disposed substantially below said top of the support, wherein substantially all the weight of said load is borne by said hook element when said closeable element is in said first open position.

* * * * *